US008567637B2

(12) United States Patent
Mori et al.

(10) Patent No.: US 8,567,637 B2
(45) Date of Patent: Oct. 29, 2013

(54) MOBILE DEVICE AND PIVOTAL COVER MEMBER THEREFORE

(75) Inventors: Yukihiro Mori, Shinagawa (JP); Hiromi Ohtsuka, Shinagawa (JP); Takeshi Miyahara, Yokohoma (JP)

(73) Assignees: Fujitsu Component Limited, Tokyo (JP); Panasonic Corporation, Osaka (JP)

( * ) Notice: Subject to any disclaimer, the term of this patent is extended or adjusted under 35 U.S.C. 154(b) by 2088 days.

(21) Appl. No.: 11/047,642

(22) Filed: Feb. 2, 2005

(65) Prior Publication Data

US 2005/0135861 A1 Jun. 23, 2005

Related U.S. Application Data

(63) Continuation of application No. PCT/JP03/09663, filed on Jul. 30, 2003.

(30) Foreign Application Priority Data

Aug. 2, 2002 (JP) ..... 2002-226158

(51) Int. Cl.
*B65D 43/22* (2006.01)
*B65D 43/14* (2006.01)

(52) U.S. Cl.
USPC ..... 220/827; 220/831; 220/833

(58) Field of Classification Search
USPC ..... 220/827, 830, 833, 843, 844, 847, 831, 220/832; 16/255, 250, 277; 429/96, 100
See application file for complete search history.

(56) References Cited

U.S. PATENT DOCUMENTS

| | | | | |
|---|---|---|---|---|
| 5,199,451 | A * | 4/1993 | Montoli | 132/315 |
| 5,206,098 | A | 4/1993 | Cho et al. | |
| 5,683,545 | A | 11/1997 | Goodwin et al. | |
| 6,409,042 | B1 | 6/2002 | Hirano et al. | |
| 6,942,118 | B2 * | 9/2005 | Zethoff et al. | 220/254.5 |

FOREIGN PATENT DOCUMENTS

| | | |
|---|---|---|
| JP | 60-172575 | 9/1985 |
| JP | 60-195450 | 12/1985 |
| JP | 61-103864 | 7/1986 |
| JP | 5-267858 | 10/1993 |
| JP | 8-329918 | 12/1996 |
| JP | 10181794 A * | 7/1998 |
| JP | 11-157170 | 6/1999 |
| JP | 2000-200983 | 7/2000 |
| JP | 2001-205895 | 7/2001 |

OTHER PUBLICATIONS

Japanese Office Action dated Apr. 11, 2006 of Application No. 2002-226158.

(Continued)

*Primary Examiner* — J. Gregory Pickett
*Assistant Examiner* — Jennifer N Zettl
(74) *Attorney, Agent, or Firm* — Staas & Halsey LLP

(57) ABSTRACT

A mobile device is disclosed. A battery housing cover mechanism (80) of the mobile device comprises a cover member (81), a pivot shaft module (90) having a pivot shaft (92), and a pivot shaft module support mechanism (100). The module (90) is movably supported by the module support mechanism (100). The pivot shaft (92) is located in the recessed section (107). When the cover member (81) is opened excessively beyond the normal open position, the module (90) is moved to pull the pivot shaft (92) out of a recessed section (107). Therefore, the pivot shaft (92) is prevented from receiving an excessive force.

5 Claims, 16 Drawing Sheets

(56) References Cited

OTHER PUBLICATIONS

Supplementary European Search Report, mailed Apr. 23, 2008 and issued in corresponding European Patent Application No. 03766663.3-2304.

Patent Abstracts of Japan, Publication No. 60-172575, published Sep. 6, 1985.

European Patent Office Communication dated Jun. 27, 2011 in Appln. No. 11157361.4.

* cited by examiner

PRIOR ART

MOBILE DEVICE AND PIVOTAL COVER MEMBER THEREFORE

CROSS REFERENCE TO RELATED APPLICATIONS

This is a Continuation of PCT Application No. PCT/JP2003/009663, now pending, filed Jul. 30, 2003, and claiming foreign priority benefit of JP 2002-226158, filed Aug. 2, 2002, the disclosures of which are incorporated herein by reference.

TECHNICAL FIELD

The present invention relates to a mobile device, and more particularly relates to a mobile device with a pivotally openable/closable cover member.

There are various types of mobile devices. Mobile terminals for inputting and outputting information, such as mobile thermal printers, are one of them. A mobile thermal printer has a battery housing for housing a battery and a paper roll housing for housing a paper roll in the body thereof. The body is provided with cover members for covering the battery housing and a cover member for covering the paper roll housing. These cover members are pivotally openable/closable, and normally closed when in use.

Since such a mobile thermal printer is a portable handheld device, a user might drop the printer or hit it on something by mistake. Therefore, it needs to be more rigid than a desk-top thermal printer.

BACKGROUND ART

FIG. 1A is an illustration showing a battery housing cover mechanism 1 of a related-art mobile thermal printer. The cover mechanism 1 has an internal pivot shaft arranged at a section recessed from the outer surface of the printer body. FIG. 1B and FIG. 1C respectively show a cover in an open position and in a closed position. In FIG. 1A through 1C, there are shown a mobile thermal printer body 2, a battery housing 3, a cover member 4, shaft portions 5 of the cover member 4 and a battery B. Bearing holes 9 are formed on a recessed section 8 recessed from an outer surface 7 of a side face 6 of the printer body 2. The shaft portions 5 of the cover member 4 are fitted in the bearing holes 9, so that the cover member 4 is attached to the printer body 2.

The cover member 4 is rotated about the shaft portions 5 fitted in the bearing holes 9 to be opened as shown in FIG. 1C.

FIG. 2A is an illustration showing a battery housing cover mechanism 20 of another related-art mobile thermal printer. The cover mechanism 20 has an exposed pivot shaft arranged on the outer surface of the printer body. FIG. 2B and FIG. 2C respectively show a cover in an open position and in a closed position. In FIG. 2A through 2C, there are shown a mobile thermal printer body 21, a battery housing 22, a cover member 23, pierced arms 24 arranged on the outer surface of the cover member 23, and holes 25. A bearing 28 is formed on an outer surface 27 of a side face 26 of the printer body 21. A shaft member 29 passing through and supported by the bearing 28 is fitted in the holes 25, so that the cover member 23 is attached to the printer body 21.

The cover member 23 is rotated about the shaft member 29 to be opened as shown in FIG. 2C.

FIG. 3A shows a paper roll housing cover mechanism 40 of a related-art mobile thermal printer disclosed in Japanese Patent Laid-Open Publication No. 11-157170. A cover member 42 is supported on a thermal printer body 41 by a shaft 43. An operations knob 44 is provided at the center of the outer surface of the cover member 42. An open/close lever 45 integrally formed with the operations knob 44 and left and right lock levers 46 and 47 are provided on the inner surface of the cover member 42. The outer ends of the lock levers 46 and 47 are respectively fitted in recesses 48 and 49 on the inner side of side plates of the printer body 41, while pins 46*a* and 47*a* on the inner ends of the lock levers 46 and 47 are fitted in cam holes 45*a* and 45*b* of the open/close lever 45.

When the operations knob 44 is slid in the Y2 direction, the cam holes 45*a* and 45*b* move the pins 46*a* and 47*a* to move the lock levers 46 and 47 closer to each other. The lock levers 46 and 47 come out of the recesses 48 and 49 to release the lock of the cover member 42, and thus the cover member 42 is opened as shown with a chain double-dashed line. For a smooth sliding movement with less friction, grease is applied on the cam holes 45*a* and 45*b*.

The cover mechanism 1 shown in FIG. 1A, when in the closed position, is hardly broken even if dropped and good in appearance. However, when in the open position, the cover mechanism 1 is not rigid enough.

To be more specific, since the shaft portions 5 of the cover member 4 are arranged at a section recessed from the outer surface 7 of the side face 6 of the printer body 2, the shaft portions 5 are prevented from receiving a direct impact and being broken even if a user drops the printer on the floor by mistake. Also, since the shaft portions 5 of the cover member 4 are not arranged outside the side face 6 of the printer body 2, the printer has a good appearance. However, as shown in FIG. 1C, an open angle θ1 of the cover member 4 is restricted at approximately 140 degrees by a shoulder 10 when the cover member 4 abuts thereon. Therefore, if a large force F1 for opening the cover member 4 further wider is applied when a user drops the printer on the floor during battery replacement, a larger force multiplied by leverage is generated in the shaft portions 5 and might break the shaft portions 5.

In contrast with the cover mechanism 1 shown in FIG. 1A, the cover mechanism 20 shown in FIG. 2A is hardly broken even if dropped and good in appearance when in the open position. However, when in the closed position, the cover mechanism 20 is not rigid enough to resist the damage of being dropped and has a poor appearance.

To be more specific, as shown in FIG. 2C, an open angle θ2 of the cover member 23 can be widened to 180 degrees until the cover member 23 abuts on the side face 26 of the printer body 21. Therefore, even if a force F1 is applied when a user drops the printer on the floor by mistake during battery replacement, no force is generated in the arms 24 and therefore the arms 24 are not broken. On the other hand, when the cover member 23 is in the closed position, the bearing 28 and the arms 24 are arranged outside the side face 26 of the printer body 21. Therefore, if a user drops the printer on the floor by mistake, the impact is directly transmitted to the arms 24 and might break the arms 24. Moreover, when the cover member 23 is in the closed position, the appearance is not good in that the arms 24 are arranged outside the side face 26 of the printer body 21.

In the case of the cover mechanism 40 shown in FIG. 3A, because grease is applied thereon, adhesion of dust to the grease or aging of the grease might affect the smooth operation. Also, since the grease spoils paper if penetrated thereto, it is not preferable to use grease in a printer for printing on paper.

The cover mechanism 40 is also disadvantageous in that the cover member is detachable and therefore easily lost.

DISCLOSURE OF THE INVENTION

A general object of the present invention is to provide a mobile device to solve at lease one problem mentioned above.

A specific object of the present invention is to provide a mobile device having a cover member pivotally attached to a mobile device body so as to be openable and closable, comprising a pivot shaft support part to movably support a pivot shaft about which the cover member is rotated, wherein the pivot shaft is moved when the cover member is opened wider than normally opened.

In this mobile device, since the pivot shaft is moved when the cover member is opened wider than normally opened, an excessive force is not applied on a shaft portion of the cover member.

Another specific object of the present invention is to provide a mobile device having a cover member pivotally attached to a mobile device body so as to be openable and closable, comprising a pivot shaft module including a pivot shaft about which the cover member is rotated, and a frame to support the pivot shaft, and a pivot shaft module support part formed on the mobile device body, supporting the pivot shaft module so that the pivot shaft is movable between a first position inside a recessed section of the mobile device body and a second position outside the recessed section, wherein the pivot shaft module support part is configured to normally support the pivot shaft module in the recessed section of the mobile device body, and to support the pivot shaft on the outside of the recessed section when the cover member is opened wider than normally opened.

In this device, since the pivot shaft module is supported, the pivot shaft is more stably supported on the mobile device body as compared to a configuration in which the pivot shaft is directly supported.

BRIEF DESCRIPTION OF THE DRAWINGS

Further objects and advantages of the present invention are set forth in the description that follows, and in part will become apparent from the description and the accompanying drawings.

BEST MODE FOR CARRYING OUT THE INVENTION

In the following, an embodiment of the present invention is described with reference to the accompanying drawings.

Figure 1A:
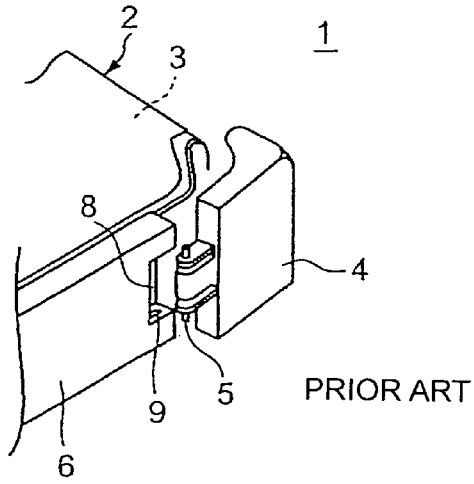
FIG. 1A is an illustration showing an example of a related-art cover mechanism.
Figure 1B:
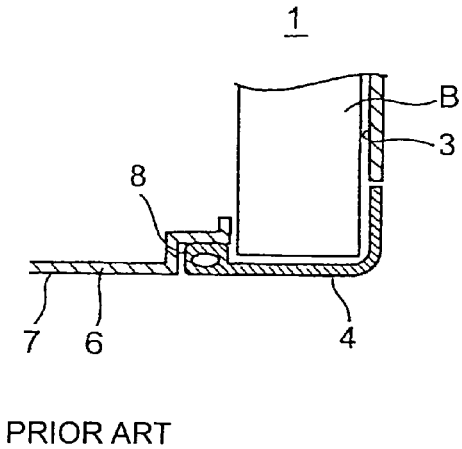
FIG. 1B is an illustration showing a cover in a closed position.
Figure 1C:
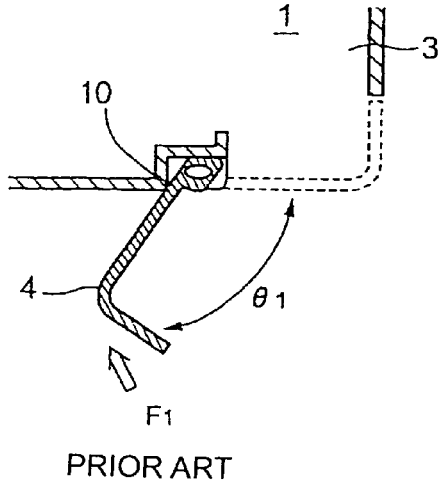
FIG. 1C is an illustration showing the cover in an open position.
Figure 2A:
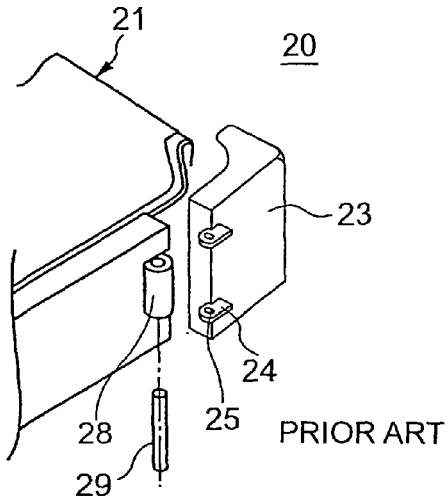
FIG. 2A is an illustration showing another example of a related-art cover mechanism.
Figure 2B:
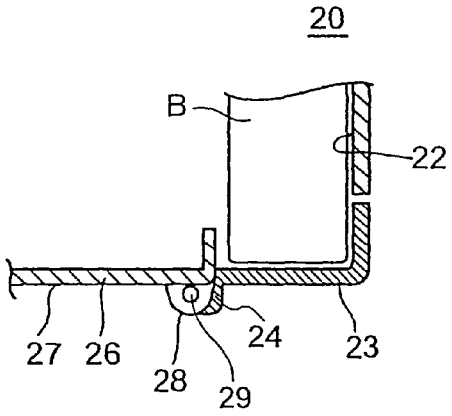
FIG. 2B is an illustration showing a cover in a closed position.
Figure 2C:
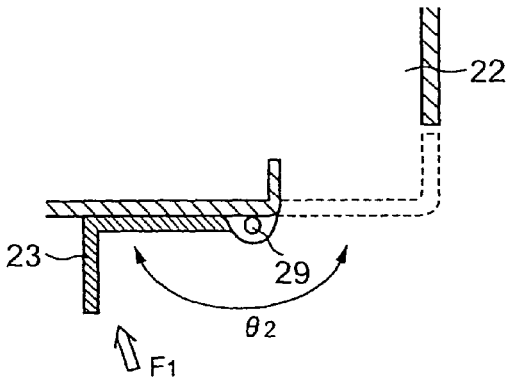
PRIOR ART FIG.2C
FIG. 2C is an illustration showing the cover in an open position.
Figure 3A:
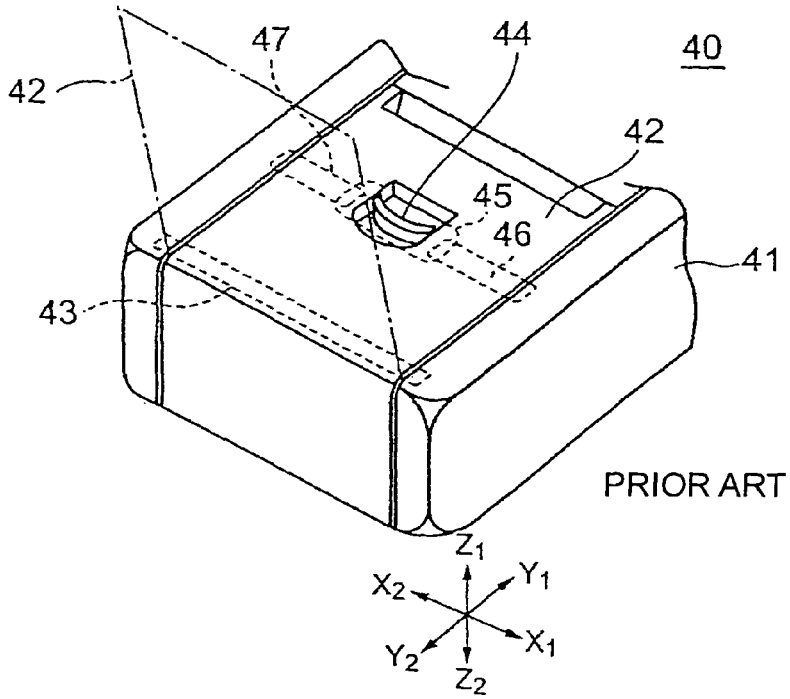
FIG. 3A is an illustration showing still another example of a related-art cover mechanism.
Figure 3B:
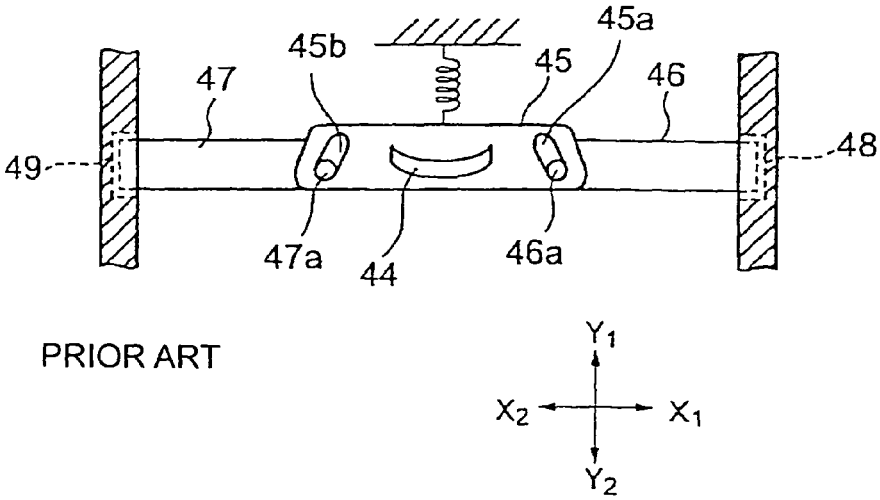
FIG. 3B is an illustration showing a mechanism at the inner side of a cover member.
Figure 4:
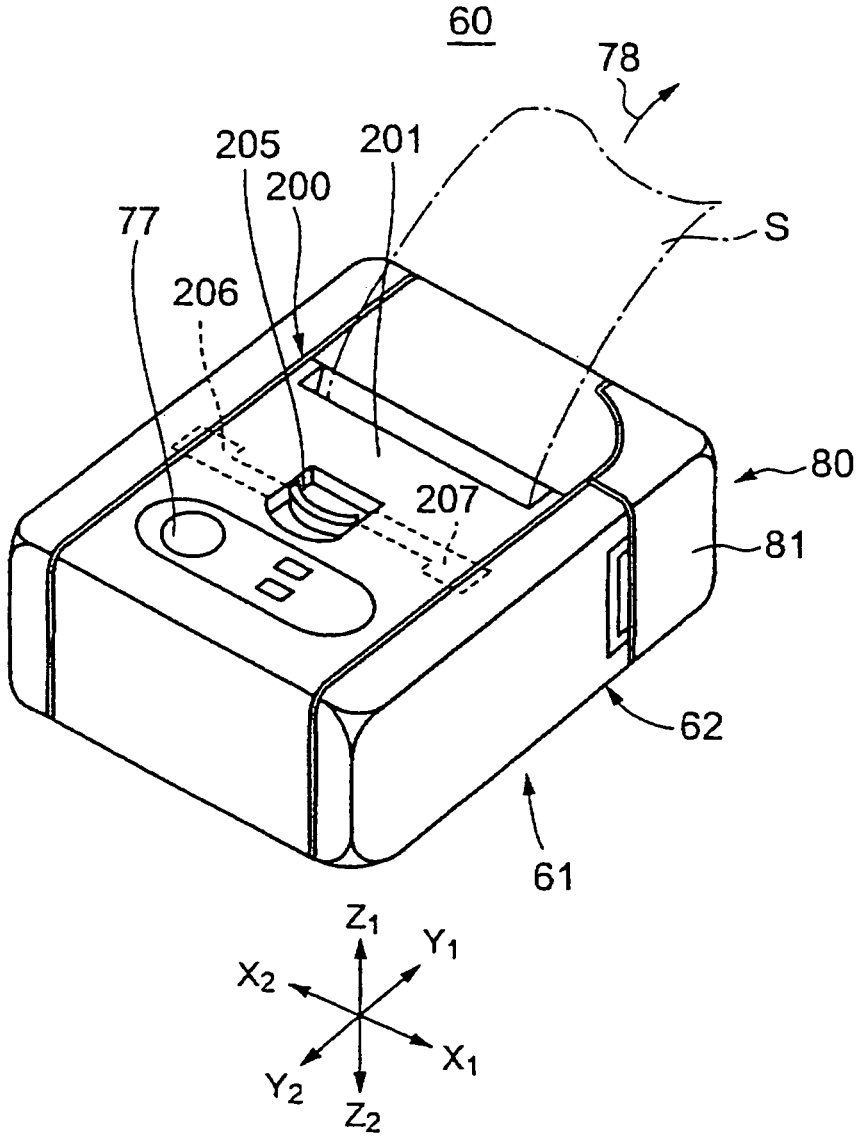
FIG. 4 is a perspective view showing a mobile thermal printer according to an embodiment of the present invention.
Figure 5:
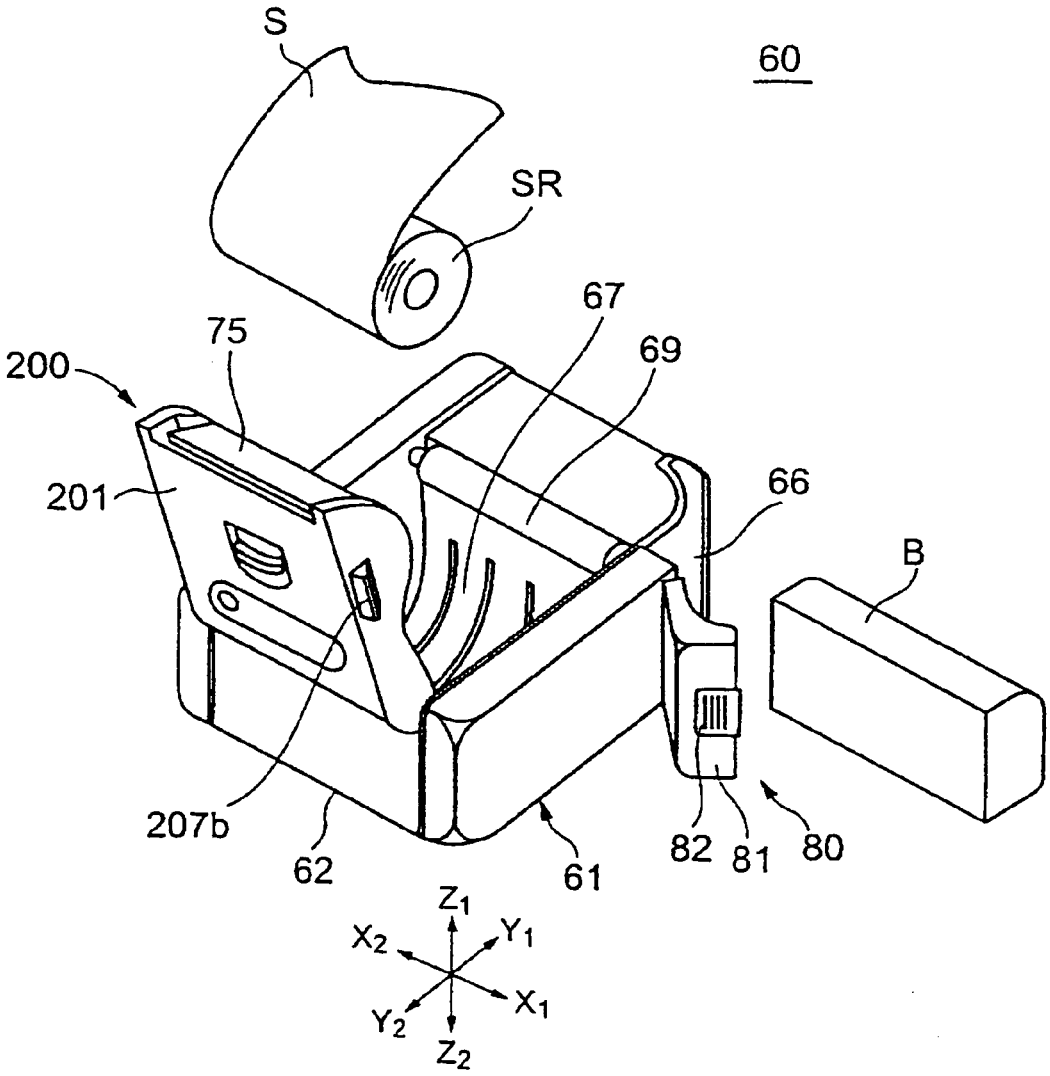
FIG. 5 is an illustration showing the mobile thermal printer of FIG. 4 with a cover member opened.
Figure 6:
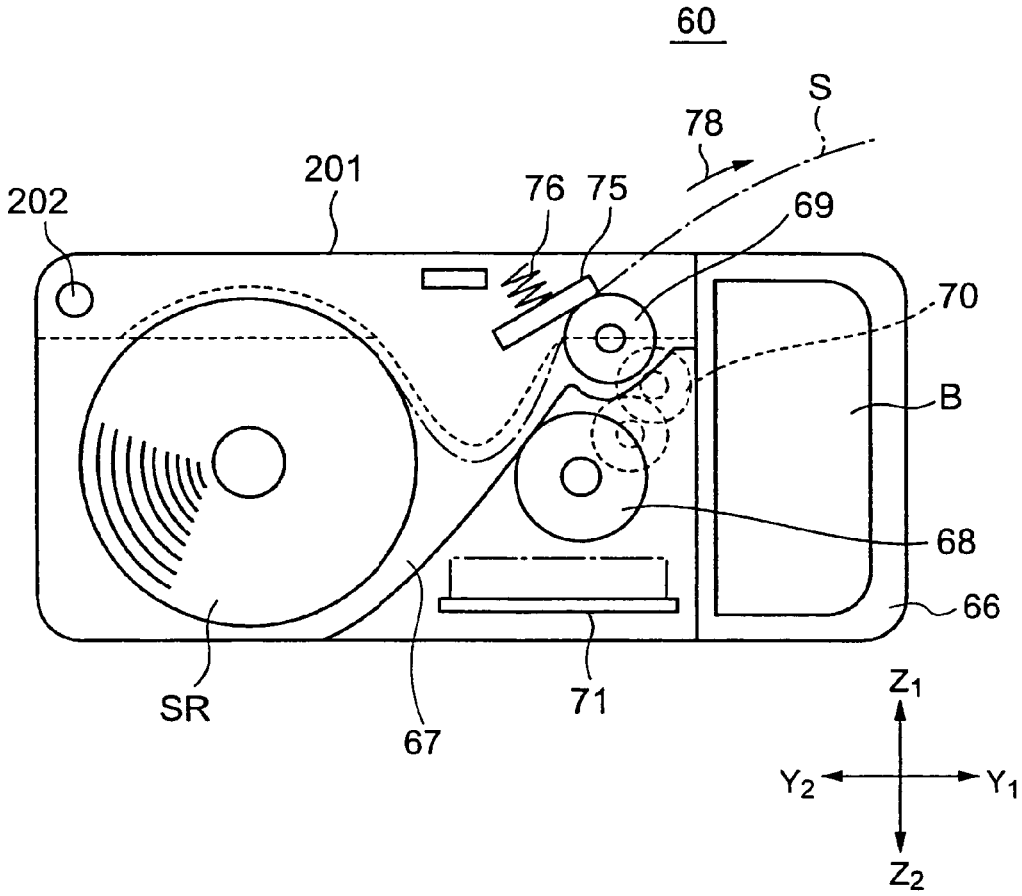
FIG. 6 is an illustration showing the inner structure of the mobile thermal printer of FIG. 4.
Figure 7:
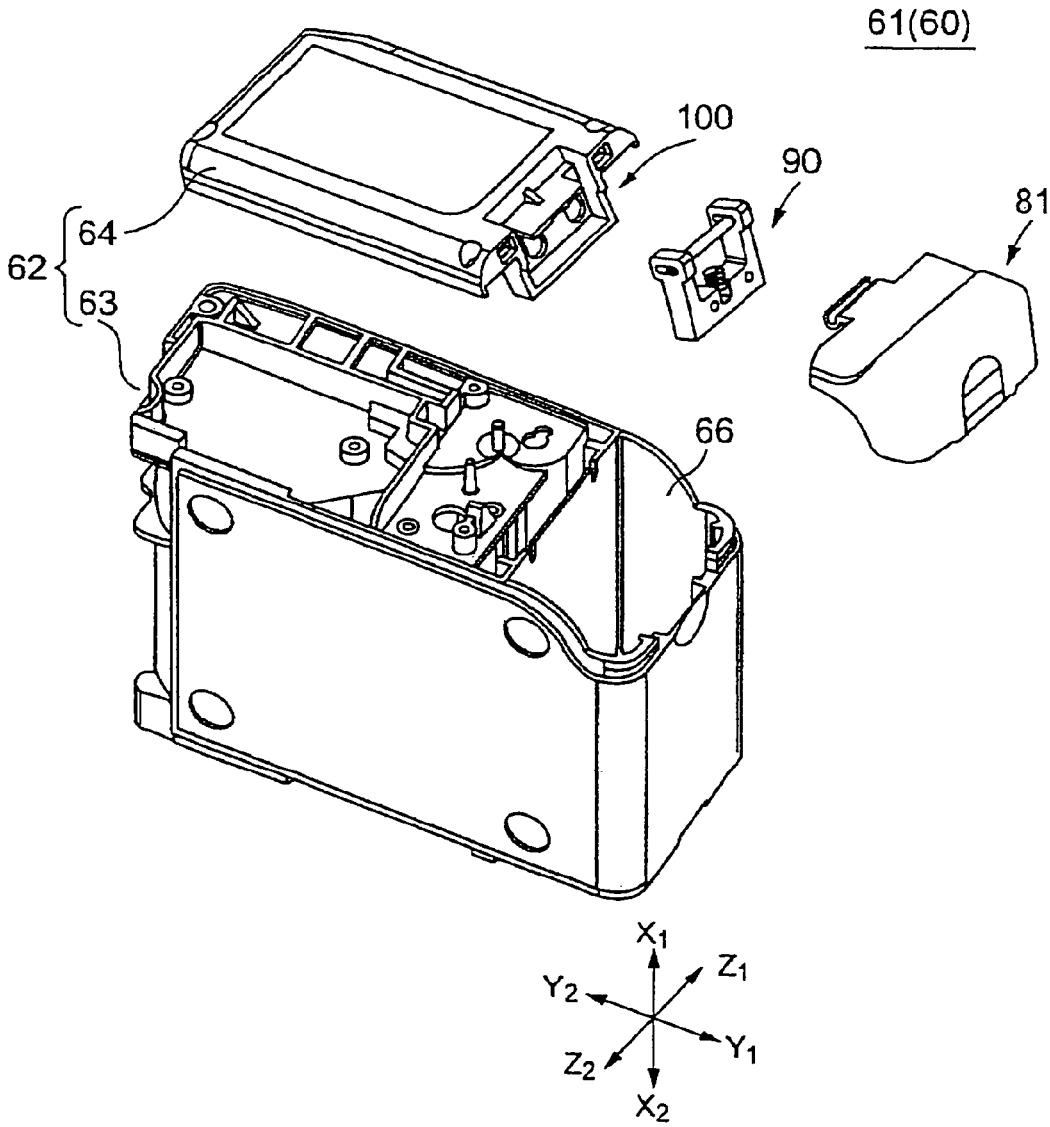
FIG. 7 is an exploded view showing the mobile thermal printer of FIG. 4.

FIGS. 4, 5 and 6 show a mobile line thermal printer 60 according to the embodiment of the present invention. FIG. 7 is an exploded view of the printer 60. The width direction is indicated by a line X1-X2, the longitudinal direction by a line Y1-Y2, and the height direction by a line Z1-Z2. The mobile line thermal printer 60 is so configured that a section for storing a print mechanism such as a thermal head and a paper roll, and a section for storing a battery are provided in a generally rectangular solid casing 61, and the size of the printer 60 is suitable to be carried. The printer 60 is a clam-shell type printer into which a paper roll can be easily loaded.

The casing 61 of the printer 60 has a casing body 62, a battery housing cover mechanism 80, and a paper roll housing cover mechanism 200. As shown in FIG. 7, the casing body 62 comprises a main body section 63 and a side plate 64 fixed thereto with screws. When cover members 81 and 201 of the cover mechanisms 80 and 200 are closed, the shape of the casing 61 is generally a rectangular solid.

The casing body 62 has a battery housing for storing a battery B at the Y1 side, and a paper roll housing 67 for storing a paper roll R at the Z1 side. The cover mechanism 80 is provided for the battery housing 66. The cover member 81 is so configured to rotate about the line Z1-Z2 between the closed position shown in FIG. 4 and the open position shown in FIG. 5 so as to allow a replacement of the battery B. The cover mechanism 200 is provided on the paper roll housing 67. The cover member 201 is so configured to rotate about a shaft member 202 on the line X1-X2 between the closed position shown in FIG. 4 and the open position shown in FIG. 5 to allow a paper roll loading. The cover member 201 is opened with a biasing force.

In the casing body 62, there are provided a paper feeding motor 68, a platen rubber roller 69, a gear mechanism 70 for transmitting the rotation of the motor 68 to the platen rubber roller 69, and a control circuit board 71. The cover member 201 has a line thermal printhead 75 biased by a spring 76 at the front end, and an operation button 77 at the upper face.

For using the printer 60, the housing 66 is covered with the cover member 81 with the battery B located therein and the housing 67 is covered with the cover member 201 with the paper roll SR located therein and a part of a sheet S being pulled out. Also, the sheet S is held between the printhead 75 and the platen rubber roller 69. When a command is sent from an external unit via wireless communication or infrared communication, the printhead 75 and the motor 68 are driven to print the sheet S and discharge the sheet S in the arrow 78 direction.

Next, the battery housing cover mechanism 80 is described.

Figure 8:
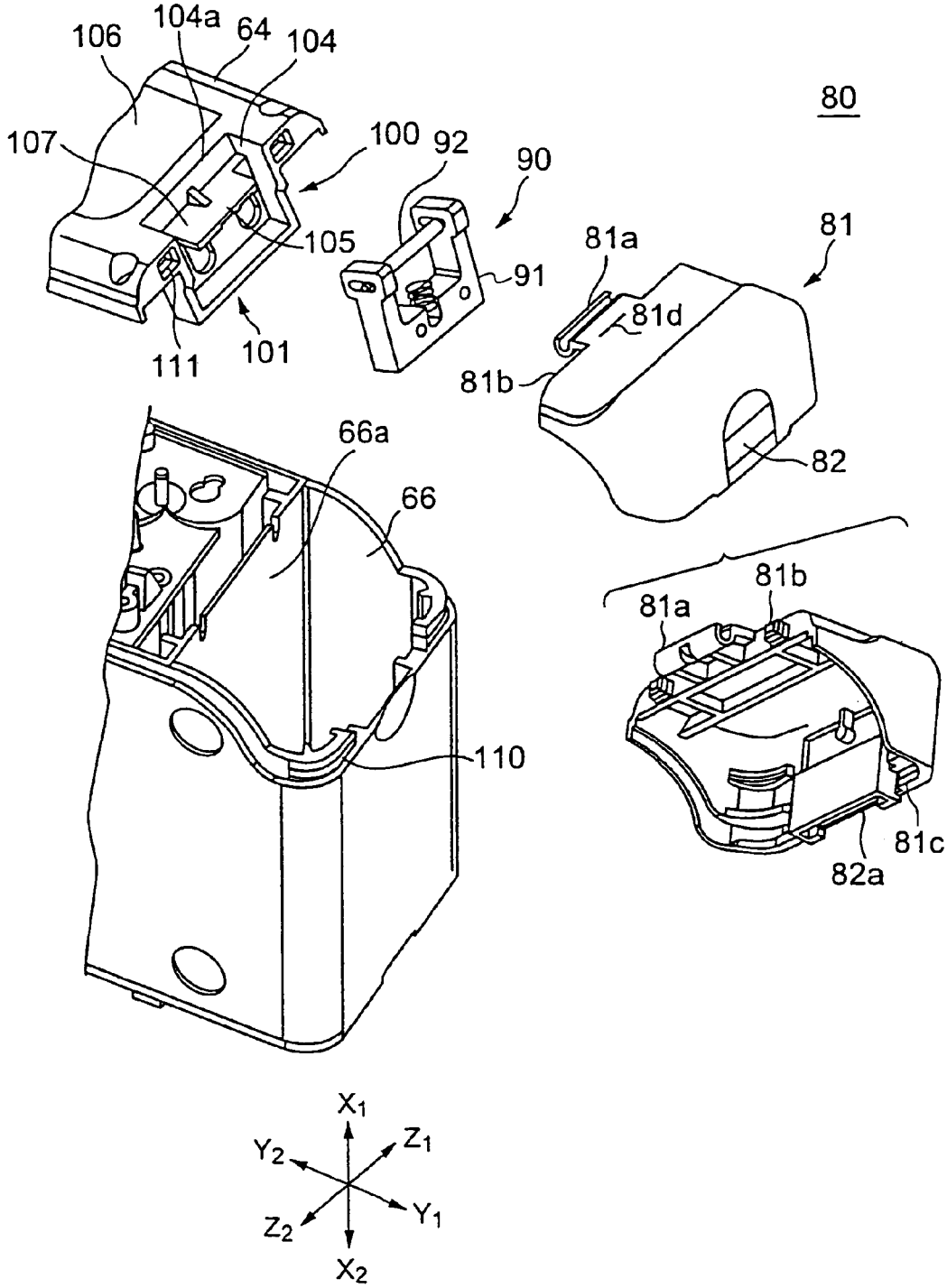
FIG. 8 is an exploded view showing a battery housing cover mechanism.
Figure 9:
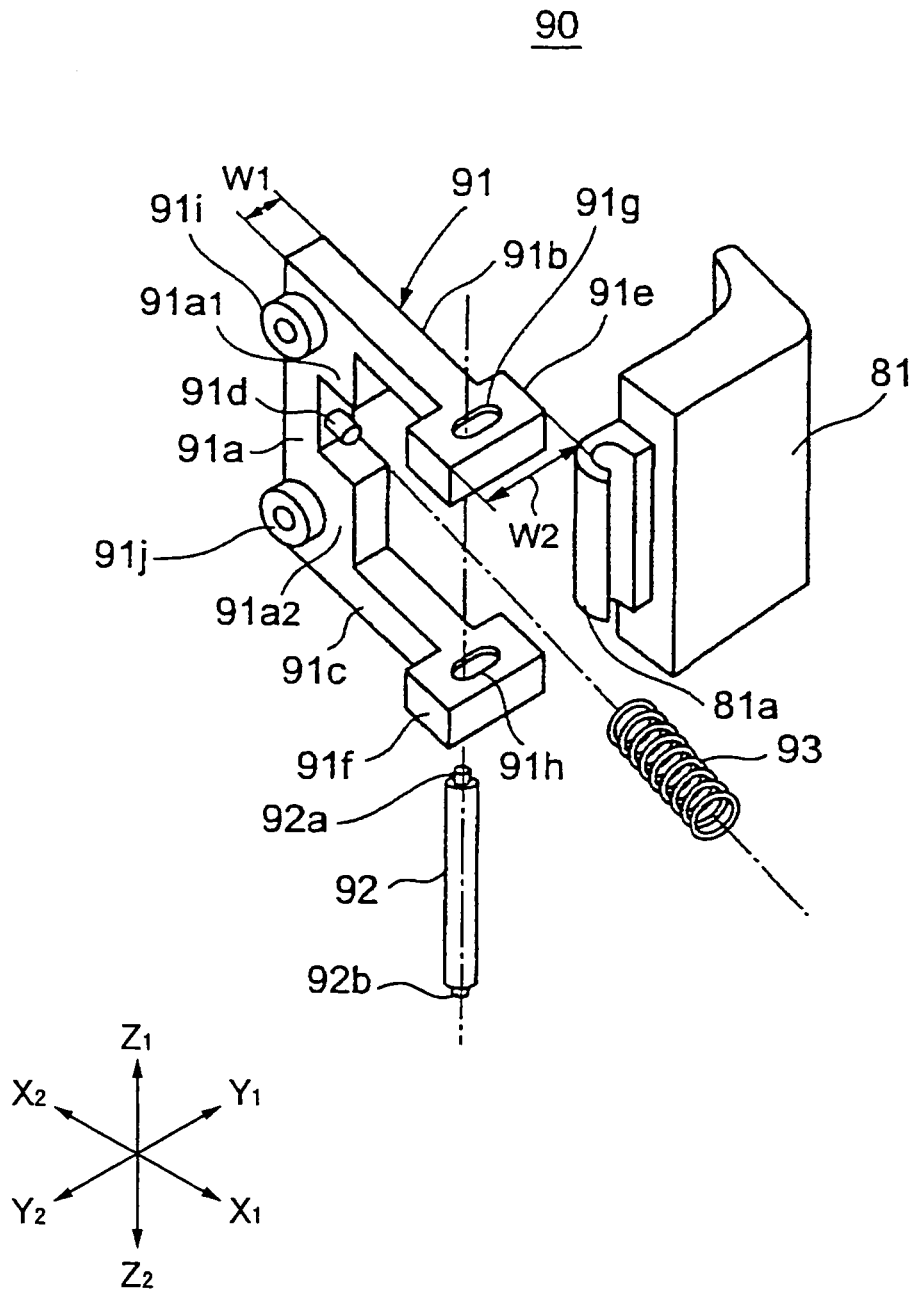
FIG. 9 is an exploded view showing a pivot shaft module shown in FIG. 8.
Figure 10:
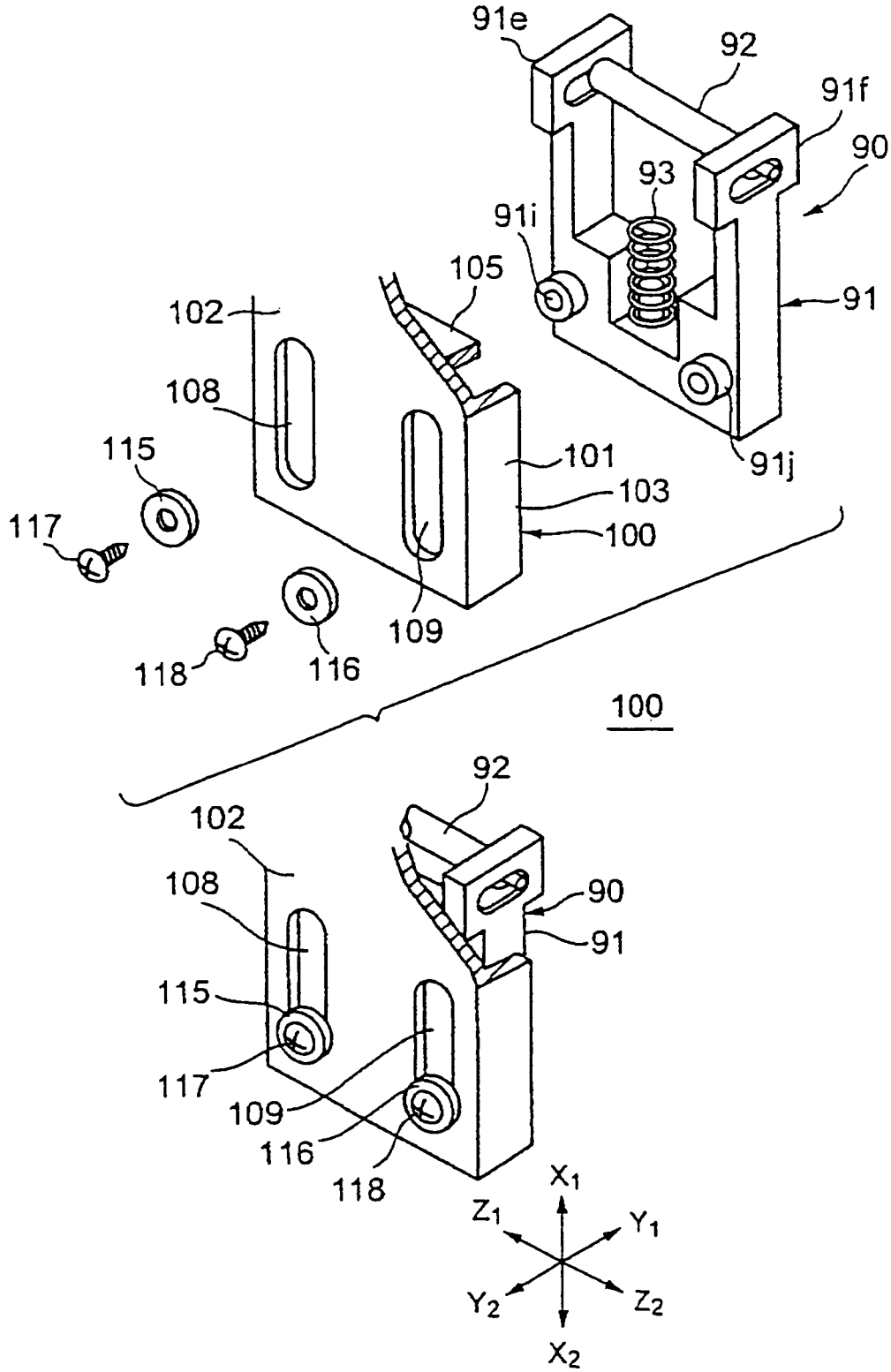
FIG. 10 is an illustration showing a pivot shaft module support structure.

FIG. 8 is an exploded view showing the cover mechanism 80 of the printer 60. FIG. 9 is an exploded view showing a pivot shaft module 90 shown in FIG. 8. FIG. 10 is an illustration showing a pivot shaft module support structure 100 supporting the pivot shaft module 90.

The cover mechanism 80 has the cover member 81, the pivot shaft module 90, and the pivot shaft module support structure 100.

The cover member 81 is generally L shaped, having a hook-like bearing 81*a* and projections 81*b* on one side and hooks 81*c* on the other side. The cover member 81 also has an operations knob 82 with a latch 82*a*.

The pivot shaft module 90, as shown in FIG. 9, comprises a U-shaped frame member 91, a pivot shaft 92, and a compression coil spring 93.

The U-shaped frame member 91 has a base section 91*a*, arms 91*b* and 91*c* extending from both sides of the base section 91*a*, a short column 91*d* at the center of the base section 91*a*, and bearings 91*e* and 91*f* on the respective tip ends of the arms 91*b* and 91*c*. A width W2 of the bearings 91*e* and 91*f* in the X1-X2 direction is greater than a width W1 of the arms 91*b* and 91*c*. The bearings 91*e* and 91*f* respectively have bearing holes 91*g* and 91*h* elongated in the width W2 direction. The bearing holes 91*g* and 91*h* are described below in more detail.

The base section 91*a* has enlarged sections 91*a*1 and 91*a*2 one on each side thereof to form a recessed section on which the column 91*d* is arranged, so that the compression coil spring 93 is easily fitted. Circular projections 91*i* and 91*j* are respectively formed on the enlarged sections 91*a*1 and 91*a*2 of the frame member 91 at the X1 side.

The pivot shaft 92 has thin shaft portions 92*a* and 92*b* one on each. The shaft portions 92*a* and 92*b* are fitted in the bearing holes 91*g* and 91*h*, so that the pivot shaft 92 is held between the bearings 91*e* and 91*f*. The pivot shaft 92 can move within the bearing holes 91*g* and 91*h* in the X1-X2 direction.

The compression coil spring 93 is fitted on the column 91*d* between the enlarged sections 91*a*1 and 91*a*2 at the inner side of the frame member 91.

Pivot shaft 92 of the pivot shaft module 90 described previously is fitted in the bearing 81*a*, so that the cover member 81 is attached to the pivot shaft module 90.

Instead of the compression coil spring 93, any spring member having the same function as the compression coil spring 93 may be installed between the frame member 91 and a support box 101, which is described later, or the like.

Figure 11A:
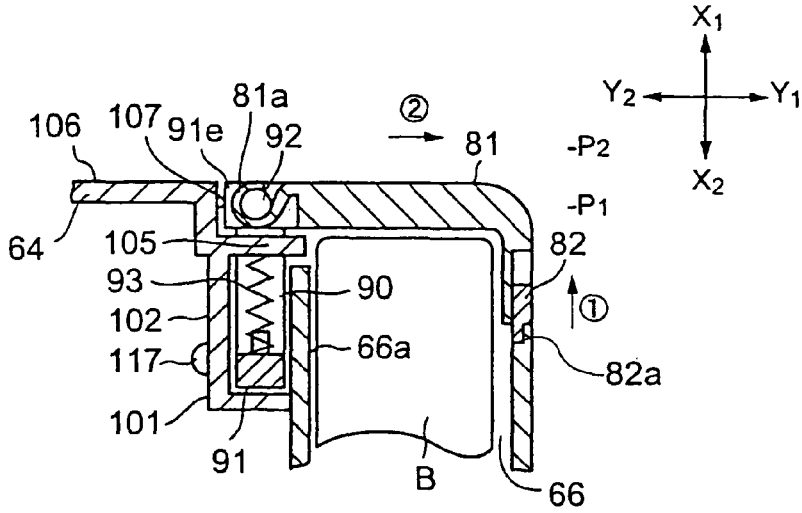
FIGS. 11A, 11B and 11C are illustrations each showing a cover member in a closed position.

The pivot shaft module support structure 100, as shown in FIGS. 10, 8, 11A and 11B, is configured like a pocket defined by the support box 101 and a wall 66*a*. The support box 101 is integrally formed with the side plate 64, having a size corresponding to the frame member 91 and a generally box shape. The support box 101 is formed at a U-shaped cutout 104 on the Y2 side end of the side plate 64, having a support plate 102 on the Y2 side, and a U-shaped surrounding section 103 around the support plate 102. When the side plate 64 is attached to the main body section 63, the open Y1 side of the support box 101 is covered with a part of the wall 66*a* of the battery housing 66 of the main body section 63 as shown in FIG. 11A. A receiving plate 105 is formed to extend toward the Y1 direction from the support plate 102. A recessed section 107 recessed from an outer surface 106 of the side plate 64 is formed at the inner side of the cutout 104 and at the X1 side of the receiving plate 105. The support plate 102 has two guide holes 108 and 109 elongated in the X1-X2 direction.

The main body section 63 has recesses 110 at the open side of the battery housing 66. The side plate 64 has recesses 111 on its end in the Y1 direction.

The pivot shaft module 90 with the cover member 81 attached thereto is located in the support box 101 and supported by the pivot shaft module support structure 100.

The frame member 91 is fitted in the support box 101 with the projections 91*i* and 91*j* respectively fitted in the guide holes 108 and 109. Tap screws 117 and 118 are threaded from the Y2 side of the support plate 102 into the projections 91*i* and 91*j* through washers 115 and 116. The pivot shaft module 90 is thus supported by the support plate 102 to be movable in the X1 direction. The displacement in the Y1 direction of the pivot shaft module 90 is restricted by the washers 115 and 116.

The pivot shaft 92 and the bearing 81*a* are positioned on the upper side of the receiving plate 105. The upper end of the compression coil spring 93 abuts on the lower surface of the receiving plate 105, biasing the frame member 91 in the X2 direction. Accordingly, the pivot shaft module 90 is pushed in the casing body 62. The pivot shaft 92, the bearing 81*a* and the bearings 91*e* and 91*f* are located in a first position P1, or, in the recessed section 107.

Figure 14:
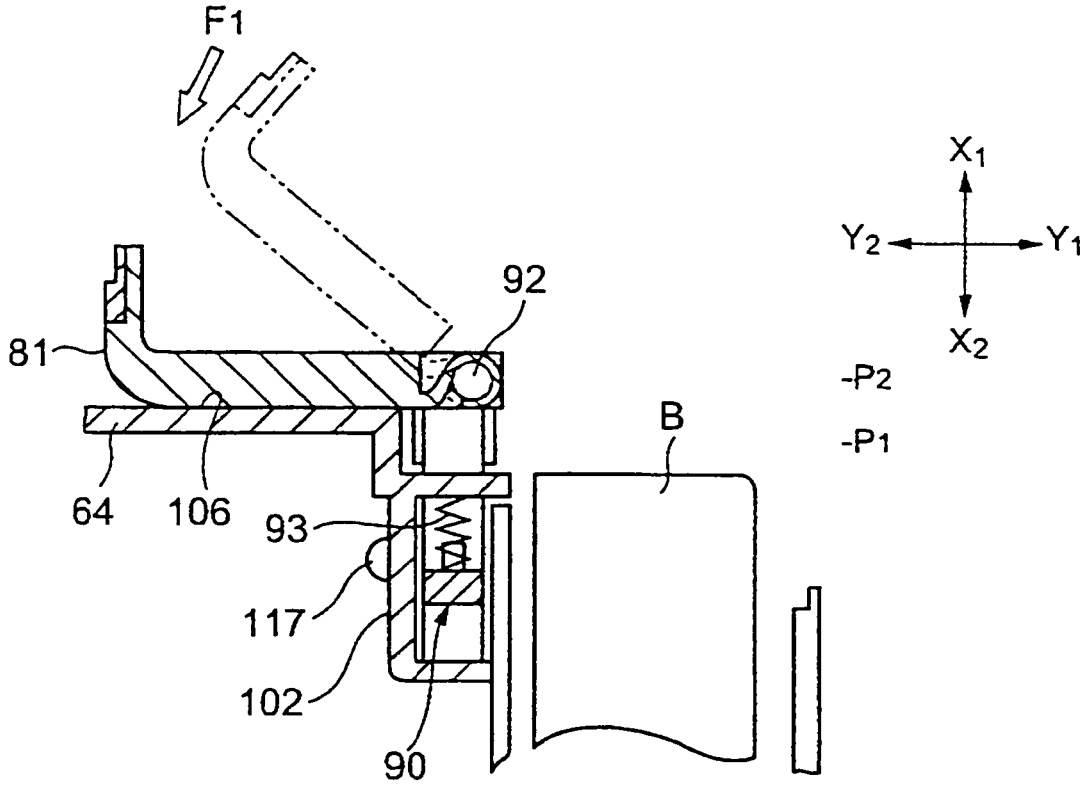
FIG. 14 is an illustration showing the cover member opened excessively.

When the pivot shaft module 90 is moved in the X1 direction, the pivot shaft 92 is pulled outside the casing body 62 to a second position P2 (see FIG. 14).

Now, an opening and closing operation of the cover member 81 is described.

Figure 11B:
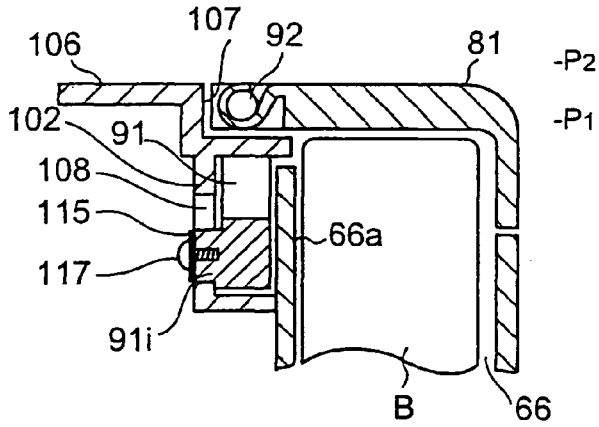
Figure 11C:
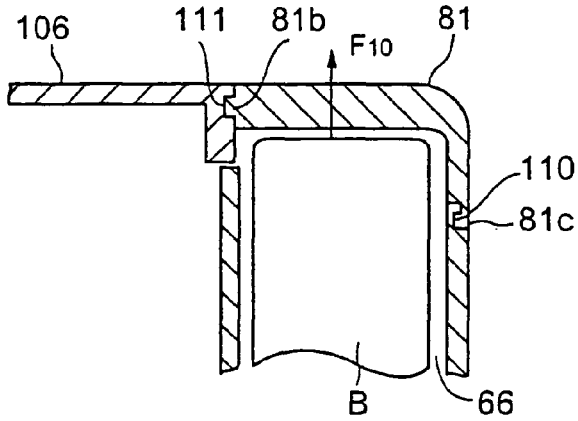

FIGS. 11A, 11B and 11C are illustrations each showing the cover member 81 in the closed position. The cover member 81 is flush with the side plate 64. The cover member 81 is locked in the closed position, with the latch 82*a* of the operations knob 82 holding the inner face of the housing 66, the hooks 81*c* engaging the recesses 110, and the projections 81*b* engaging the recesses 111. If an impact is applied to the printer 60 when, for example, dropped on the floor by mistake, the impact in the Y1 direction is absorbed by the latch 82*a*.

If the impact is applied in the X1 direction, the battery B pushes the inner face of the cover member 81 in the X1 direction so as to jump out from the housing 66. At this time, a force F10 to open the cover member 81 from the inside is applied to the cover member 81. The force F10 is received at both ends of the force F10 by the engagement of the hooks 81*c* and the recesses 110 and the engagement of the projections 81*b* and the recesses 111. Accordingly, even if an impact is applied to the printer 60, the cover member 81 is not easily opened.

Also, since the bearings 91*e* and 91*f*, the bearing 81*a*, and the pivot shaft 92 are located in the recessed section 107 without projecting outwardly onto the side face 106 of the casing body 62, the bearings 91*e* and 91*f* and the bearing 81*a* are preventing from hitting directly on the floor and receiving direct impact even if the printer 60 is dropped on the floor by mistake. Therefore, the pivot shaft module 90 is prevented from being broken. In addition, since there are no projections outside the side face 106 of the casing body 62, the printer 60 has a good appearance and can be smoothly stored in a carry case.

To open the cover member 81, a user releases the lock by performing a first operation indicated by an arrow ① shown in FIG. 11A and then a second operation indicated by an arrow ②.

Figure 12A:
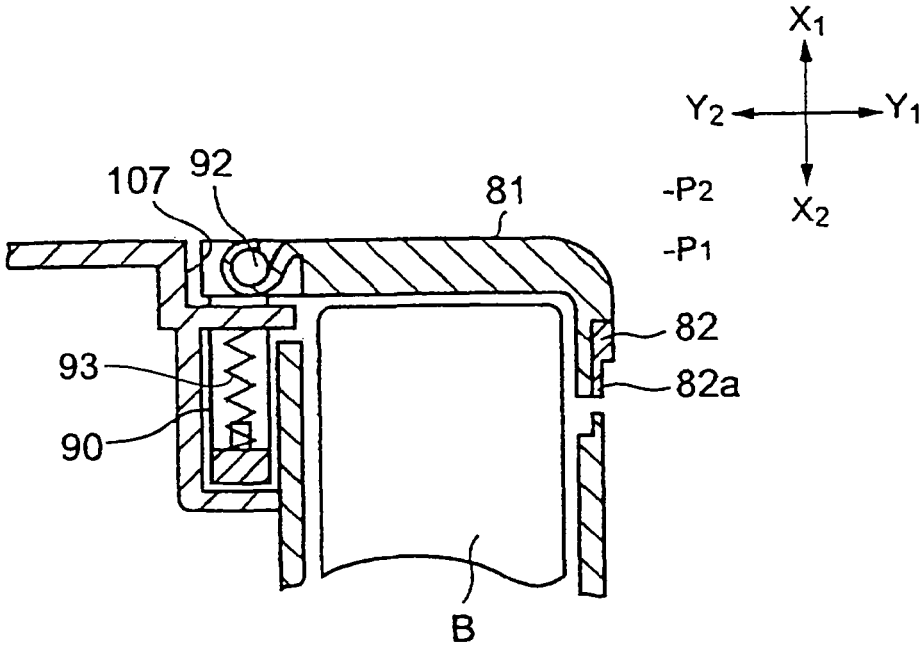
FIGS. 12A and 12B are illustrations each showing the cover member with a lock released.
Figure 12B:
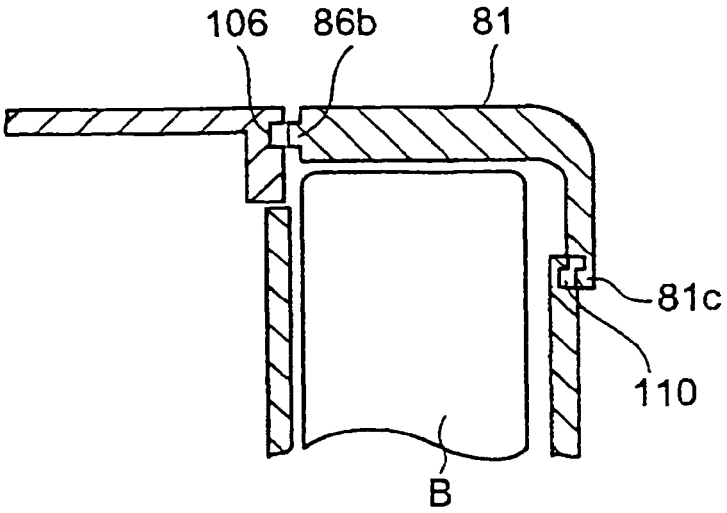

FIGS. 12A and 12B respectively show the state after the first operation and the state after the second operation.

The first operation is an operation to slide the operations knob 82 in the X1 direction. With this operation, the inner face of the housing 66 is released from the latch 82*a*.

The second operation is an operation to pull the cover member 81 in the Y1 direction. This operation allows the hooks 81*c* to come out of the recesses 110 and the projections 81*b* to come out of the recesses 111 and thus releases the engagement.

Figure 13:
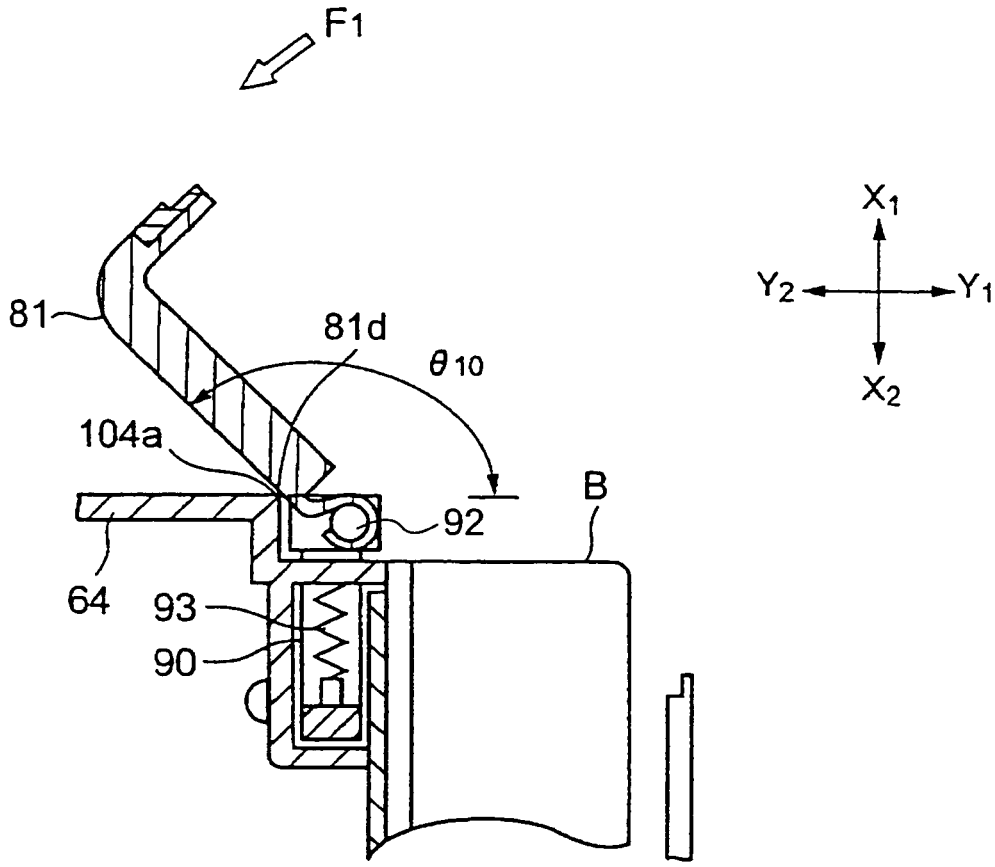
FIG. 13 is an illustration showing the cover member opened normally.

Then, the cover member 81 is rotated and opened as shown in FIG. 13. Herein, the open angle θ10 of the cover member 81 is approximately 140 degrees, and a part of the cover member 80 indicated by a reference numeral 81*d* near the bearing 81*a* abuts on an inward edge 104*a* of the cutout 104 of the side plate 64. The battery B is replaced in this state.

After the battery B is replaced, the cover member 81 is closed and locked as shown in FIGS. 11A, 11B and 11C by performing the above operation in reverse order.

In the opening operation previously described, when the cover member 81 is pulled in the Y1 direction so as to release the lock, a force in the Y1 direction applied on the pivot shaft module 90 is received by the support plate 102 through the washers 115 and 116 and, therefore, no force is applied on the wall 66*a* of the battery housing 66. This prevents the wall 66*a* from being damaged and broken even with repeated use.

In the following description, assume that when the cover member 81 is opened as shown in FIG. 13 for a battery replacement, the printer 60 hits on something and a large force F1 to open the cover member 81 further wider is applied thereon.

When the force F1 is applied as shown in FIG. 13, the cover member 81 tries to rotate about the edge 104*a* in the counter-clockwise direction.

When the cover member 81 tries to rotate in the counter-clockwise direction, the pivot shaft module 90 is pulled in the X1 direction to move in the X1 direction. The pivot shaft 92 comes out of the recessed section 107 to a second position P2 at the outer side of the casing body 62. Since the pivot shaft 92 is moved in the X1 direction in this way, the bearing 81*c* does not receive a large force. Therefore, the bearing 81*c* is prevented from releasing the pivot shaft 92 or being broken.

The cover member 81 is opened excessively until it abuts on the side face 106 of the casing body 62. In this state, the force F1 is received by the side face 106 of the casing body 62. The cover member 81 is not opened further wider, and no further force is applied on the pivot shaft module 90.

When the application of the force F1 shown in FIG. 14 is stopped by, for example, removing a hand that has been pushing the cover member 81, the pivot shaft module 90 is moved in the X2 direction to be pulled back to the first position P1 in the recessed section 107 with the biasing force of the compression coil spring 93. The cover member 81 is rotated in the closing direction and automatically moved back to the position shown in FIG. 13. This configuration, conveniently, eliminates the need to manually move back the pivot shaft 92 into the recessed section 107.

Even if the pivot shaft 92 is formed integrally with the cover member 81, it is possible to move the pivot shaft 92 in the X1 direction as described above.

The bearing holes 91*g* and 91*h* are described below with reference to FIGS. 15A and 15B.

The bearing hole 91*h* is formed in a generally ellipse shape elongated in the Y1-Y2 direction, having a first circular hole 91*h*1 at the Y1 side, a second circular hole 91*h*2 at the Y2 side and a narrow section 91*h*3 between the holes 91*h*1 and 91*h*2. The bearing hole 91*g* is formed in the same shape, having a first circular hole 91*g*1 at the Y1 side, a second circular hole 91*g*2 at the Y2 side and a narrow section 91*g*3 between the holes 91*g*1 and 91*g*2.

Figure 15A:
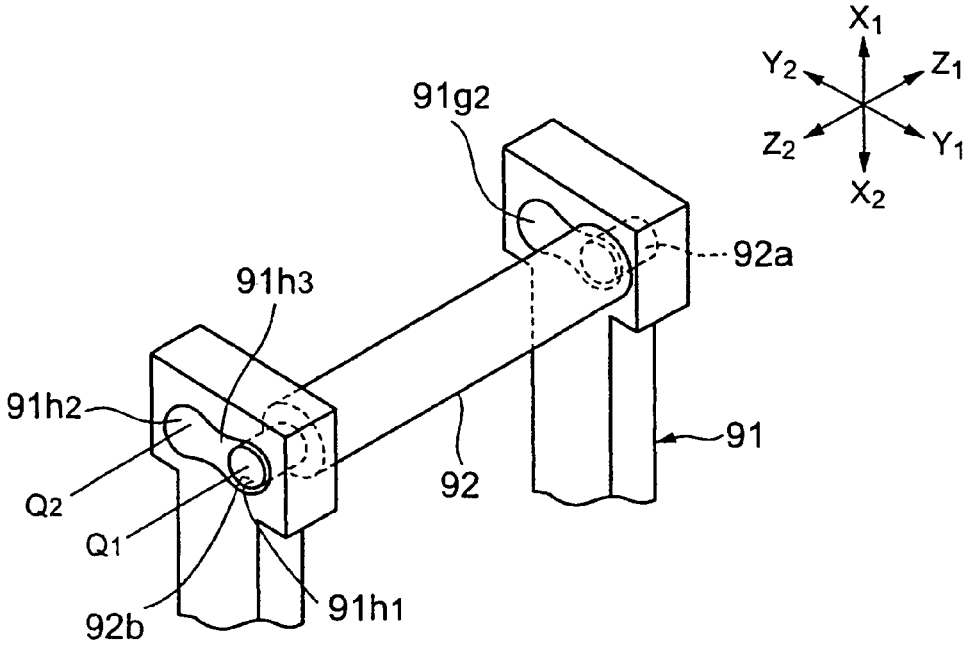
FIG. 15A is an enlarged view showing a section supporting the pivot shaft of the pivot shaft module when the cover member is in an open position.
Figure 15B:
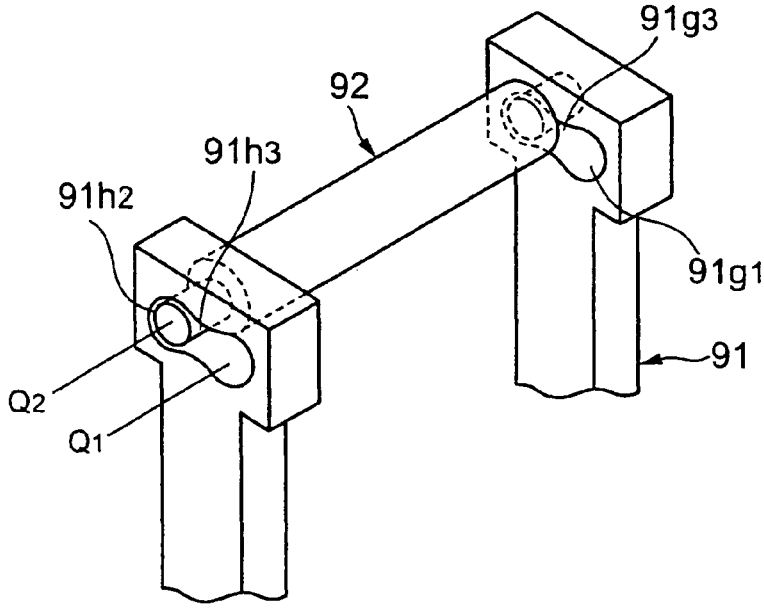
FIG. 15B is an illustration showing the pivot shaft being supported when the cover member is in closed position.

Referring to FIG. 15A, the pivot shaft 92 is located in a position Q1 at the Y1 side with the shaft portions 92*b* and 92*a* respectively fitted in and supported by the first circular holes 91*h*1 and 91*g*1. The pivot shaft 92 is located in this position when the cover member 81 is opened.

The cover member 81 is rotated to be closed and then moved in the Y2 direction so that the hooks 81*c* are engaged in the recesses 110 and the projections 81*b* are engaged in the recesses 111.

The movement of the cover member 81 in the Y2 direction causes the shaft portions 92*b* and 92*a* to pass through the narrow sections 91*h*3 and 91*g*3 to the second circular holes 91*h*2 and 91*g*2, and thus clicks the pivot shaft 92 therein, i.e., in a position Q2. With this click, a user can make sure that the cover member 81 is moved in the Y2 direction.

The paper roll housing cover mechanism 200 is described below with reference to FIG. 4 and FIG. 16A through 16D.

Figure 16A:
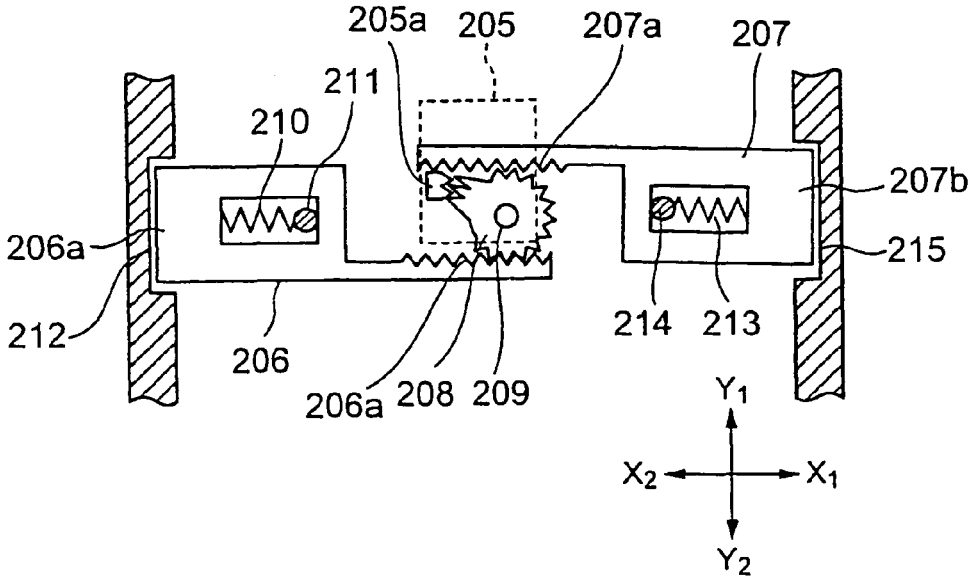
FIG. 16A is an illustration showing a paper roll housing cover mechanism.
Figure 16B:
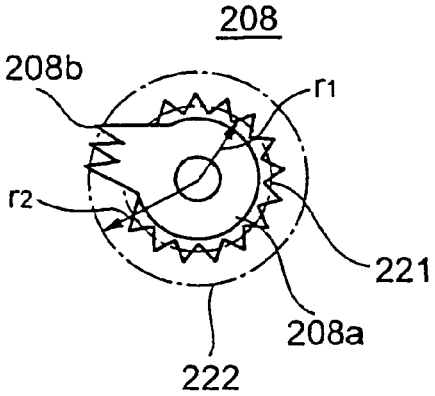
FIGS. 16B and 16C are illustrations each showing a two-stage gear.
Figure 16C:
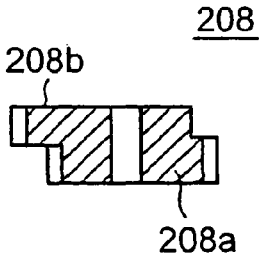
Figure 16D:
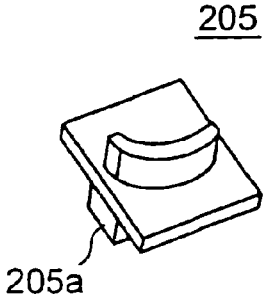
FIG. 16D is an illustration showing an operations knob.

An operations knob 205 shown in FIG. 16D is provided on the upper face of the cover member 201. Left and right lock levers 206 and 207 having the same structure and a two-stage gear 208 are installed at the lower side of the cover member 201 as shown in FIG. 16A.

The two-stage gear 208 is provided with a first gear section 208*a* and a second gear section 208*b* integrally and is supported by a shaft portion 209 of the cover member 201. A pitch circle 221 of the first gear section 208*a* has a radius r1. A pitch circle 222 of the second gear section 208*b* has a radius r2 longer than a radius r1.

A rack 206*a* of the lock lever 206 and a rack 207*a* of the lock lever 207 mesh with the first gear section 208*a*. The lock lever 206 is urged in the X2 direction by a spring 210 to contact a pin 211, and an end section 206*a* is fitted in a recess 212. The lock lever 207 is urged in the X2 direction by a spring 213 to contact a pin 214, and an end section 207*a* is fitted in a recess 214. The cover member 201 is thus locked in a closed state.

A rack section 205*a* on the lower face of the operations knob 205 meshes with the second gear section 208*b*.

When the operations knob 205 is slid in the Y2 direction, the two-stage gear 208 is rotated. The lock levers 206 and 207 interlocked thereto are moved closer to each other and come out of the recesses 212 and 215 to release the lock. The cover member 201 is thus opened as shown in FIG. 5.

Since gears are used for transmitting the movement of the operations knob 205 to the lock levers 206 and 207, the movement is smoothly transmitted without using grease. Accordingly, trouble caused by application of grease, such as slow operations movement due to adhesion of dust to the grease or aging of the grease, stains of the grease penetrated on paper or the like, are avoided.

The stroke of the operations knob 205 to release the lock can be set as desired by changing the ratio of the pitch circle radius r1 of the first gear section 208*a* to the pitch circle radius r2 of the second gear section 208*b*.

It should be appreciated that the cover mechanisms 80 and 200 are applicable to PDAs (Personal Digital Assistants) digital cameras, video cameras, and cellular phones, etc., without being limited to mobile thermal printers.

The invention claimed is:

1. A mobile device having a cover member pivotally attached to a mobile device body via a pivot shaft module so as to be openable and closable, the mobile device comprising:

a pivot shaft module including a pivot shaft about which the cover member is rotated, and a frame to support the pivot shaft; and a pivot shaft module support part formed on the mobile device body, supporting the pivot shaft module so that the pivot shaft is movable between a first position inside a recessed section of the mobile device body and a second position outside the recessed section;

wherein the pivot shaft module support part supports the pivot shaft module so that the pivot shaft is located in the recessed section of the mobile device body when the cover member is in a position angled less than a predetermined angle, and the pivot shaft is located on the outside of the recessed section when the cover member is in a position angled greater than the predetermined angle.

2. A mobile device having a cover member pivotally attached to a mobile device body via a pivot shaft module so as to be openable and closable, the mobile device comprising:

a pivot shaft module including a pivot shaft about which the cover member is rotated, and a frame to support the pivot shaft;

a pivot shaft module support part formed on the mobile device body, supporting the pivot shaft module so that the pivot shaft is movable between a first position inside a recessed section of the mobile device body and a second position outside the recessed section, wherein the pivot shaft module support part is configured to support the pivot shaft module so that the pivot shaft is located in the recessed section of the mobile device body when the cover member is in a position angled less than a predetermined angle, and the pivot shaft is located on the outside of the recessed section when the cover member is in a position angled greater than the predetermined angle; and a spring part configured to bias the pivot shaft module so as to position the pivot shaft in the recessed section of the mobile device body.

3. A mobile device having a cover member pivotally attached to a mobile device body via a pivot shaft module so as to be openable and closable, the mobile device comprising:

a pivot shaft module including a pivot shaft about which the cover member is rotated, and a frame to support the pivot shaft;

a pivot shaft module support part formed on the mobile device body, supporting the pivot shaft module so that the pivot shaft is movable between a first position inside a recessed section of the mobile device body and a second position outside the recessed section, wherein the pivot shaft module support part is configured to support the pivot shaft module so that the pivot shaft is located in the recessed section of the mobile device body when the cover member is in a position angled less than a predetermined angle, and the pivot shaft is located on the outside of the recessed section when the cover member is in a position angled greater than the predetermined angle; and wherein the pivot shaft module further includes a spring part configured to bias the pivot shaft so as to position the pivot shaft in the recessed section of the mobile device body.

4. The mobile device as claimed in claim 1, wherein the pivot shaft module support part attaches and supports the frame of the pivot shaft module on a support plate formed on the mobile device body.

5. A mobile device having a cover member pivotally attached to a mobile device body via a pivot shaft module so as to be openable and closable, the mobile device comprising:

a pivot shaft module including a pivot shaft about which the cover member is rotated, and a frame to support the pivot shaft; and a pivot shaft module support part formed on the mobile device body, supporting the pivot shaft module so that the pivot shaft is movable between a first position inside a recessed section of the mobile device body and a second position outside the recessed section;

wherein the pivot shaft module support part supports the pivot shaft module so that the pivot shaft is located in the recessed section of the mobile device body when the cover member is in a position angled less than a predetermined angle, and the pivot shaft is located on the outside of the recessed section when the cover member is in a position angled greater than the predetermined angle, wherein the frame includes a bearing hole in which the pivot shaft is supported, the bearing hole having a shape formed by circular holes on both sides and an opening between the circular holes that is narrower than a diameter of either of the circular holes, and the pivot shaft is forced to pass through the opening between the circular holes when the pivot shaft supported in one of the circular holes is moved into the other hole.

* * * * *

UNITED STATES PATENT AND TRADEMARK OFFICE

CERTIFICATE OF CORRECTION

PATENT NO. : 8,567,637 B2
APPLICATION NO. : 11/047642
DATED : October 29, 2013
INVENTOR(S) : Yukihiro Mori et al.

It is certified that error appears in the above-identified patent and that said Letters Patent is hereby corrected as shown below:

On the Title Page, In Column 1 (Inventors), Line 3, Delete "Yokohoma" and insert -- Yokohama --, therefor.
On the Title Page, In Column 2 (Abstract), Line 4, Delete "(I00)." and insert -- (100). --, therefor.
On the Title Page, In Column 2 (Abstract), Line 6, Delete "(I00)." and insert -- (100). --, therefor.

Signed and Sealed this
Twenty-fifth Day of February, 2014

Michelle K. Lee

Michelle K. Lee
*Deputy Director of the United States Patent and Trademark Office*